US010264899B2

(12) United States Patent
Biebl

(10) Patent No.: US 10,264,899 B2
(45) Date of Patent: Apr. 23, 2019

(54) NECK PILLOW

(71) Applicant: Boris Biebl, Bottrop (DE)

(72) Inventor: Boris Biebl, Bottrop (DE)

( * ) Notice: Subject to any disclaimer, the term of this patent is extended or adjusted under 35 U.S.C. 154(b) by 261 days.

(21) Appl. No.: 15/022,566

(22) PCT Filed: Sep. 22, 2014

(86) PCT No.: PCT/EP2014/070158

§ 371 (c)(1),
(2) Date: Jun. 10, 2016

(87) PCT Pub. No.: WO2015/040224

PCT Pub. Date: Mar. 26, 2015

(65) Prior Publication Data

US 2016/0278553 A1 Sep. 29, 2016

(30) Foreign Application Priority Data

Sep. 21, 2013 (DE) ..... 10 2013 015 583

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/1081; A47G 9/00; A47G 9/10; A47G 9/1072; A47G 9/109;
(Continued)

(56) References Cited

U.S. PATENT DOCUMENTS 4,916,765 A 4/1990 Castronovo, Jr.
5,214,814 A 6/1993 Eremita et al.
(Continued)

FOREIGN PATENT DOCUMENTS

DE 20 2010 012 488 U1 11/2010
EP 2 130 461 A1 12/2009
(Continued)

OTHER PUBLICATIONS

DIN 53 577: "Determination of compression stress value and compression stress-strain characteristic for flexible cellular materials", pp. 1-3 (1988).

*Primary Examiner* — Eric J Kurilla
(74) *Attorney, Agent, or Firm* — Norman B. Thot

(57) ABSTRACT

A neck pillow includes a supporting body comprising a foot, a shoulder contact surface and a negative inclination starting from the foot, a supporting surface comprising a convex-shaped cervical support area and a concave-shaped head support area, a rigid portion comprising a rigid portion hardness and a bottom curve which comprises a highest point, and a soft portion arranged on an upper side of the rigid portion, the soft portion comprising a soft portion hardness which is less than the rigid portion hardness. The supporting body is configured so that each of a head and a cervical spine of a person rests on the soft portion. The highest point is arranged in an area of the fifth and sixth cervical of the person. The shoulder contact surface migrates with an average radius of curvature of less than 2 cm in a support area of the sixth cervical of the person.

27 Claims, 7 Drawing Sheets

(58) Field of Classification Search
CPC .... A47G 2009/1018; A61H 2201/1604; A61H 2201/1607; A61H 2201/1609; A61H 2201/1611; A61H 2201/1614; A61H 2201/1616; A61H 2201/1635; A61H 2201/1638; A61H 2203/0443; A61H 2203/0456; A61H 2203/0475; A61H 2205/02; A61H 2205/04; A61H 2205/06; A61H 2205/062; A61H 2205/065; A61H 2205/067
See application file for complete search history.

(56) References Cited

U.S. PATENT DOCUMENTS 5,533,218 A * 7/1996 Fahy ..... A47C 27/144 5/421
5,682,633 A 11/1997 Davis
5,864,904 A * 2/1999 Rudick ..... A47G 9/10 5/490
D442,006 S * 5/2001 Miller ..... D6/601
6,345,401 B1 * 2/2002 Frydman ..... A47G 9/10 5/636
6,381,784 B1 * 5/2002 Davis ..... A61G 7/07 5/636
6,513,179 B1 2/2003 Pan
6,823,546 B1 * 11/2004 Hsu ..... A47G 9/007 5/636
7,013,512 B1 * 3/2006 Hsu ..... A47G 9/1081 5/636
2012/0054966 A1 3/2012 Bacon
2013/0047338 A1 * 2/2013 Lin ..... A47G 9/1081 5/636
2013/0191997 A1 * 8/2013 Dennewald ..... A47G 9/1081 5/636

FOREIGN PATENT DOCUMENTS

FR 2 670 375 A1 6/1992
JP 7-163448 A 6/1995
WO WO 99/52405 A1 10/1999

* cited by examiner

NECK PILLOW

CROSS REFERENCE TO PRIOR APPLICATIONS

This application is a U.S. National Phase application under 35 U.S.C. § 371 of International Application No. PCT/EP2014/070158, filed on Sep. 22, 2014 and which claims benefit to German Patent Application No. 10 2013 015 583.5, filed on Sep. 21, 2013. The International Application was published in German on Mar. 26, 2015 as WO 2015/040224 A1 under PCT Article 21(2).

FIELD

The present invention relates to a neck pillow.

BACKGROUND

Neck pillows have previously been described. These usually comprise a surface contour which have their highest point of pressure in the area of the upper to middle cervical spine and thus lead to an unfavorable (for the nervous system) to high pressure to the upper cervicals, particularly to the atlas and axis in the anterior direction. This can cause headaches and, in extreme cases, nervous disorders and circulatory disorders as well as sleep disorders. Other previously-described pillows support the cervical spine, but, considered in a longitudinal direction, fall too far back off towards the head and then too rapidly so that too much pressure is exerted on the uppermost cervical C1, the atlas. No pillow to date completely supports the cervical spine, thoracic spine, shoulders, and arms satisfactorily, and which is sufficiently adjustable. The position of the arms when lying on the side has to date not been considered. Previously-described neck pillows are not sufficiently adaptable to different cervical spines.

SUMMARY

An aspect of the present invention is to provide an improved neck pillow.

In an embodiment, the present invention provides a neck pillow which includes a supporting body comprising a foot, a shoulder contact surface and a negative inclination starting from the foot, a supporting surface comprising a convex-shaped cervical support area and a concave-shaped head support area, a rigid portion comprising a rigid portion hardness and a bottom curve which comprises a highest point, and a soft portion arranged on an upper side of the rigid portion, the soft portion comprising a soft portion hardness which is less than the rigid portion hardness. The supporting body is configured so that each of a head and a cervical spine of a person rests on the soft portion. The highest point is arranged in an area of the fifth and sixth cervical of the person. The shoulder contact surface migrates with an average radius of curvature of less than 2 cm in a support area of the sixth cervical of the person.

BRIEF DESCRIPTION OF THE DRAWINGS

The present invention is described in greater detail below on the basis of embodiments and of the drawings in which.

DETAILED DESCRIPTION

Figure 1:
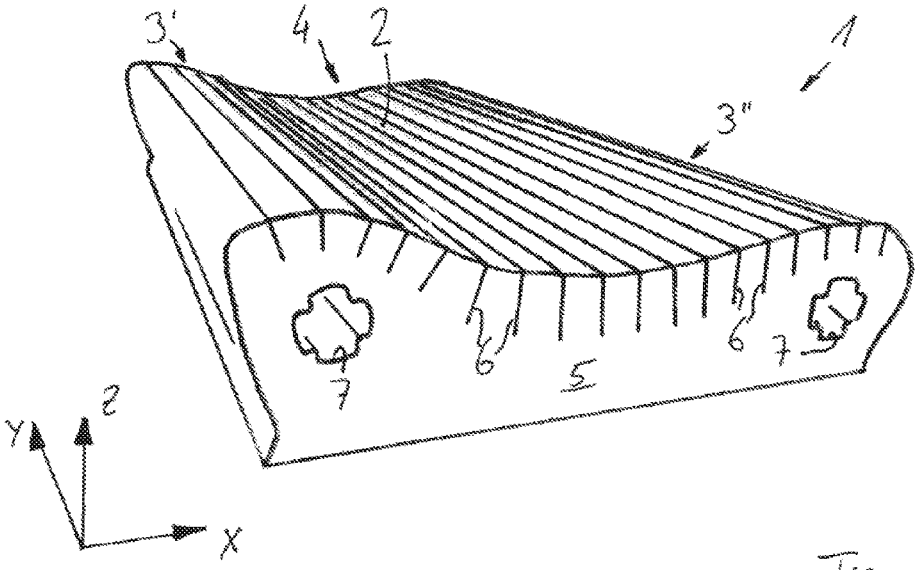
FIG. 1 shows an inventive neck pillow in a perspective view.

The neck pillow of the present invention comprises a supporting body with a supporting surface having a convex-shaped cervical support area and a concave head support area. A person can contact the respective areas with the cervical spine and the head. The supporting body is formed in particular of a foam material, in particular of a foam material having a compression hardness of more than 1.7 kPa at 40% compression, for example, of about 1.9 kPa at 40% compression. The term "compression hardness" as used herein is understood as the pressure in kPa which physically acts on an area measured in square meters which is required according to DIN 53 577 to compress the foam by 40%. A preferred foam material is HRC or a PU foam. A viscoelastic foam is also suitable. A reduced compressive hardness of about 1.1 kPa at 40% compression is also suitable for comfort pillows.

In an embodiment of the present invention, the supporting body can, for example, be formed in one piece and in particular has the same compressive hardness in all areas. This allows for an inexpensive production. The variation of the supporting characteristics in different areas of the pillow is in particular performed by the separate adjustment devices, which will be explained below in greater detail, e.g., adjustment roller or bottom plates.

The neck pillow in particular has its highest point in the support area of the cervicals C5 and C6, namely, the lower cervical spine. The supporting point of the middle cervical C3 and C4 is in particular already located lower than the support point of the fifth cervical C5. C1 to C7 indicate the cervicals or, in reference with the pillow, the cervical support area specifically for this vertical, counted from top to bottom.

In an embodiment of the present invention, the inventive neck pillow can, for example, be designed so that it applies the highest pressure to the cervicals in the area of the lower cervicals C5-C7 to relieve the upper cervicals C1-C3. The pillow comprises one or more of the following features for this purpose:

- A shoulder contact surface of the pillow has a negative inclination, starting from the foot of the pillow, in particular having an angle relative to the vertical of 8° to 20°.
- The shoulder contact surface migrates with a mean radius of curvature of less than 2 cm, for example, of about 1.5 cm, into the support area of the cervical C6, which is in particular aligned approximately nearly horizontally;

The pillow comprises a rigid portion which is covered on its upper side by a soft portion. The head of the person as well as the person's cervical spine rests on the soft portion. The soft portion has less hardness than the rigid portion. A bottom curve defines the border between the hard portion and the soft portion.

The highest point of the bottom curve and thus of the hard portion in the area of the cervical spine lies in the area of the cervicals C5 and C6.

The highest points of both the bottom curve and the head curve have, in an axial direction, a maximum distance of 6 cm from the foremost point of the shoulder contact surface.

The bottom curve has a decreasing curvature having an average radius of curvature having a maximum of 5 cm between the areas C2 and C6. The head curve has, between the supporting areas of the second and sixth cervical (C2, C6), a decreasing curvature having an average radius of curvature which is greater than the radius of curvature ($K_{17,\ C3C6}$) of the bottom curve in this area. The center of curvature of the bottom curve and/or the head curve can, for example, be arranged in front of (i.e., downwards of the cervical spine in a direction of the thoracic spine) the supporting area of the fourth cervical.

The soft portion has a maximum thickness of 2 cm at area C6, in particular a maximum of 1.5 cm. The soft-portion has a thickness of at least 2 cm in the area C2, in particular a maximum of 2.5 cm.

In an embodiment of the present invention, the supporting body can, for example, comprise a plurality of slots projecting from the cervical support area and/or from the head support area into the supporting body. The slots in the head support area can, for example, project deeper into the supporting body than the slots in the cervical support area. The support pillow is selectively weakened in its stability via the slots. At the per se quite high compressive hardness, which is inherent in the used material, the hardness is selectively reduced by the slots and adjusted to a desired level. The head is heavier than in the side position in the supine position. The head thus sinks to deeper areas of the supporting body. The upper cervicals are thereby relieved. When lying on the side, a main load of the head is already supported by the shoulders so that the head sinks less heavily and the weakened areas of the head support area therefore also provide sufficient support. This is sufficient for a planar aligning of the spine when lying on the side, when viewed in a sagittal direction.

The slots are largely defined by a head curve and a bottom curve. The head curve is defined by the upper starting point of the slots at the supporting surface. The bottom curve is defined by the lower end of the slots within the supporting body. The bottom curve in principle substantially follows the contact surface and thus also the head curve. The bottom curve is convex curved in the area of the cervical spine. The bottom curve is again curved concave in the area of the head support area. The bottom curve is, however, in the area of the head area, farther away from the head curve than the bottom curve in the area of the cervicals. The bottom curve therefore decreases stronger than the head curve in the area of the upper cervicals. The slots may therefore also be aligned to deviate from an exact vertical alignment, but may be aligned slightly angled, facing downwards in direction of the shoulder, particularly in the area of the first cervicals C1 to C3. If the upper cervicals then rest on the supporting surface, the vertical pressure of the cervicals in a downward direction at the same time causes a longitudinal force component so that the cervicals are stretched from each other due to their own weight, i.e., urged towards the head.

The head and the bottom curve extend in a longitudinal direction. The supporting body generally has a constant profile in the transverse direction. The head support area softly embeds the back of the head in the supine position and the face in a side position.

In an embodiment of the present invention, the supporting surface can, for example, comprise two cervical support areas. These are arranged at respectively opposite sides of the head support area. The two cervical support areas are different in their characteristics. The profile of the head curve of the slots, the profile of a bottom curve of the slots, and/or the orientation of the slots relative to a vertical line can in particular vary. One can generate two characteristics with one single pillow merely by turning the pillow. A therapist can therefore preset the pillow in two different characteristics. At night the patient can automatically choose between these two preset characteristics.

The second pillow side can, for example, have with the second cervical support area a steeper or gentler decrease in the bottom curve compared to the head curve. In particular if both the head curve and the bottom curve have a flatter profile, this arrangement is more suitable for cervicals already having a lordosis or hyperlordosis. Caused by the typical workloads, most cervicals are, however, rather steep and have a hyperlordosis or are even kyphotic, i.e., have an insufficient lordosis-curve.

In an embodiment of the present invention, the supporting body can, for example, comprise, in the longitudinal area of the cervical support area, a transversely arranged receiving recess for an adjustment roller. The adjustment roller can be fixed in different angular positions within the receiving recess. The surface of the adjustment roller can, for example, be formed complementary to the receiving recess. The fixation in the different angular positions in particular results by a selectively, complementary shaped, non-circular surface contour of the receiving recess and of the adjustment roller, which allows the adjustment roller to be inserted in the receiving recess only in certain selective angular positions. The axis of the adjustment roller can, for example, be placed below the support area of the fifth or sixth cervical. The approximate maximum diameter of the adjustment roller is in particular 4 cm, for example, a maximum of 2 cm.

In an embodiment of the present invention, the adjustment roller can, for example, be formed substantially cylindrical and has, in a side view several, in particular four, radial projections, which are identically designed and in particular uniformly distributed around the circumference. The receiving areas are accordingly provided in the receiving recess suitable for the projections. Each of the angular positions can then be associated to a specific damping characteristic of the cervical support area.

In an embodiment of the present invention, at least one of the projections can, for example, be removable. If one of the projections is removed, the supporting body is supported correspondingly lower by the adjustment roller at a defined location. Through the different angular positions, it can now be specified at which point the recess should be missing. Via an adjustment roller having four projections, of which one projection is removable, six characteristics can already be set:

1 The complete roller can be used.

2 No roller is used.

3-6 The roller with the removed projection is inserted in four different angular positions.

Via the adjustment roller, the pressure on a single cervical can therefore be specifically adapted. Due to the projections, the adjustment roller is maintained to be rotationally fixed within the recess and cannot be twisted unexpectedly. The reproducibility of a particular setting can also be easily provided which is, in contrast, not possible with a completely round roller. In the present embodiment, the stepped adjustability is in this case thus certainly more advantageous than a continuous adjustability.

In an embodiment of the present invention, the supporting body can, for example, be cut clear in the receiving recess. This creates two U-legs which together encompass the receiving recess in a U-shaped manner. The two enclosing U-legs may interlock each other in a form-fitting way, considered at least in the longitudinal direction or in longitudinal and height direction, so as to prevent an unintentional release and falling out of the adjustment roller.

In an embodiment of the present invention, a separate bottom plate having an inclination can, for example, be fixed below the supporting body. The supporting body can thus be aligned in its inclination. There may also be provided a plurality of bottom plates, in particular, one additional bottom plate, which also has an inclination. The inclination can be realized by a wedge profile of the bottom plate. In an embodiment, a form-fitting fastening device can, for example, be provided, in particular a form-fitting fastening device acting in the height direction and in the longitudinal direction. These can be formed by transversely arranged receiving recesses in the form of grooves which are attached to the underside of the supporting body. The bottom plate may comprise tongue-shaped fastening projections which are in particular aligned in the transverse direction. These and any other fastening projections specified in the present application can have a mushroom shaped cross-section. The grooves and the projections are in particular aligned in the transverse direction. Six different settings can, for example, be realized via two of the inclined bottom plates:

1 There is no plate present.
2 The two plates are complementary aligned with each other so that a uniform elevation is given.
3 Only one plate is mounted, the elevated side towards the body.
4 Only one plate is mounted, the lower side towards the body.
5 Both elevated sides lie upon each other towards the body.
6 Both lower sides are lie upon each other towards the body.

A combination of further bottom plates is also suitable to generate further variability.

With respect to all fastening projections mentioned in the present application, these can, for example, be formed to be tongue-shaped and can, for example, be aligned in the transverse direction. Due to this transverse orientation, these comprise a high stability of connection in the longitudinal direction.

In an embodiment of the present invention, a third bottom plate can, for example, be provided, which can be placed below the supporting body and, if applicable, also below the first and second bottom plate. The bottom plate has a head area recess, which is in particular provided beneath the head support area and which is in particular considered in the transverse direction disposed centrally below the supporting body. This head area recess weakens the supporting body below the head support area, thereby causing specific therapeutic measures for the supine position and the side position. The result is that in the supine position, the neck pillow resting on the shoulders has, in the area of the 5th-6th cervicals, the highest point, in the area of the most prominent cervical C7, the pillow decreases steeply, and the first two upper thoracics T1 and T2 are gently supported by the additional rounded elevation. This upper thoracic support zone may in turn be reduced by removing the inserted adjustment roller or be increased by using a harder foam. A too strong support would again prevent the formation of the natural kyphosis of the thoracic spine. The variable selective and definable support, to be conducted by the customer, or the relief of singular areas of the spine starting from the atlas and axis to the upper thoracic vertebrae is important because, in particular, the dislocation of vertebrae in an inferior and in a posterior direction can lead to irritations of nerves and can lead to neuroforaminal narrowness and subluxations. According to Dr. Clarence Gonstead DC (Doctor Of Chiropractic), a steep orientation of the cervical spine is produced especially by a tilting of the lower cervicals in a posterior-inferior direction along a displacement with the corresponding intervertebral discs core. By shifting of the vertebrae, diseases of the intervertebral discs are accordingly possible which can be counteracted by an optimum and protective support at night.

Since the head area recess, viewed in a transverse direction, is located centrally, and the width of the support zone can individually be adjusted very easily to the neck portion by cutting (e.g., with a scissor/knife), the position of the shoulder and the cervical spine and of the head in a side position is not adversely affected by the head area recess.

The head area recess provides a good central positioning of the head and the cervical spine. It at the same time provides that the head, which requires a higher position in the side position than in the supine position to support, in the side position, a perfectly straightened cervical spine to the lower vertebrae, achieves this higher position via a reduced sinking in the region outside of the head recess. A person typically rolls the head when turning into the side position from the center of the pillow to the lateral area (transversely outside). The supporting force is here now increased by underlying the third bottom plate, caused by the limitation of the head area recess to central transverse area.

A separately attachable thoracic vertebrae support roller is further provided which can, for example, be formed integrally with the third bottom panel. The thoracic vertebrae supporting roller can, for example, also be located only in the central transverse area to support the thoracic spine exclusively in the supine position. If the thoracic vertebrae supporting roller would be arranged in the outer transverse areas, the underlying shoulder, which in a side position in principle forms a V-shaped incision with the cervical spine, would push/remove the pillow away from the body so that the support of the cervical spine would shift into the unfavorable upper cervical spine area. The neck pillow would thus no longer be able to automatically adjust the incision of the shoulder in an upward direction.

In an embodiment of the present invention, the head area recess and/or the thoracic vertebrae support roller can, for example, generally be merely as wide as the neck in transverse direction. During rolling on the side, the shoulder has also enough room. The head area recess enables an optimal sinking zone for the head in a supine position. It furthermore enables that, in the side position, the person comes to rest outside of the head area recess where an additional good support of the supporting body is provided which is not reduced by the head area recess. The third bottom plate can be fixed with the supporting body and/or the other bottom plate by a form-fitting engagement device which have already been described in another context.

The invention further refers to a cushion assembly including a neck pillow of the aforementioned type. In particular one or two side pillows can, for example, be provided, one side pillow at the right and one side pillow left of the neck pillow. Such side pillow includes a support body having a supporting surface which has a rising forearm support portion, a convex-shaped wrist support area, and a concave-shaped finger support area. A convex shaped grab area may be connected to the finger support area.

Such a side pillow serves to support an arm if the person is in the supine position is or both arms if the person is a side position. If the person is in the supine position, it can be advantageous if two such side pillows are provided, one of which is located left of the neck pillow and one of which is located right of the neck pillow. In the supine position, the arm or the hand lies with its top side on the side pillow. The palm therefore "looks" upwards.

If the person lies in a side position, the lower hand lies on the pillow, as previously described. The upper hand can lie on the same pad, but with the palm facing downwards. Then the grab area can be enclosed by the fingers of the upper hand. The palm of the upper hand lies then in the concave finger rest area. In right side position of the person is the right hand/the right arm the lower hand/arm and the left hand/left arm is the upper hand/arm. The lower upper arm is then substantially arranged transversely and the lower arm lies approximately perpendicular thereto in the longitudinal direction. Through raising the lower arm by supporting through the lower arm supporting surface, the outer rotation of the upper arm relative to the shoulder may be reduced and thus improved. The shoulder joint is thus moved into a position that is more comfortable for the person as if the arm rests directly on the mattress. The protective effect thus obtained is also relevant to the precluded miss-tension/posture of the underlying wishbone, of the shoulder blade, of the first rib, and consequently also of the lower cervical spine, and of important nerve centers like the plexus brachialis, the ganglion stellatum, as well as the overall supply of the nerve and the vessels of the arm.

The side pillow is aligned with the rising surface facing in the direction of the foot of the person, the concave finger support area or the convex-shaped grab area facing towards the head. If the person lies on the side, the person puts the forearm of the lower arm with the back side on the side pillow, wherein the back side of the hand with the ossicles of the fingers lies in the depression, namely the concave finger support area. With the upper hand, the person can put the palm and the base of the thumb in the depression, namely the concave-shaped finger support area. The person embraces the high pillow side, which is formed by the convex grab area, with the fingers.

The side pad is formed to be adjustable in height. The adjustability is obtained analogous to the possibilities which are described for the neck pillow through the fitting of bottom plates. An adjustment roller may likewise be provided, as was previously described with respect to the neck pillow. The previous statements referring to the bottom plate and the adjustment roller are therefore adoptable to the side pillow.

In an embodiment of the present invention, the side pillow can, for example, be connected via a fastening device with the neck pillow and/or, if present, with a further side pillow on the other side of the neck pillow. The present pillows can thus each be accommodated in one pillowcase which are connected to each other with a slight elastic web of fabric. This may come to rest below the neck pillow. This basically allows the two side pillows to be freely placed while preventing or at least reducing a slippage during sleep. The elasticity of this connection may still allow some displacement or tilting of the side pillow with respect to the neck pillow. This variability can be extended by a connection of the side pillows with the underlying web. A kind of marriage-variant one side pillow can thereby be placed between two neck pillows of the here described kind, which may be shared by two persons.

One or more inclined bottom plates can in particular be used and placed under the side pillows, which are in particular configured to be inclined, substantially analogous as described for the neck pillow. It can be advantageous if the angled orientation of the bottom plate occurs in the transverse direction. This means that the side pillow can, for example, be oriented to be increasing or decreasing, as viewed in a direction away from body. The wedge shape of the bottom plate thus faces laterally away from the body or towards the body.

With respect to the adjustment roller, different materials may be used both for the adjustment roller for the neck pillow and for the adjustment roller for the side pillow. Foam of different qualities, hardnesses, and sinking behavior can, for example, be used with the adjustment roller. Adjustment rollers can also be used which are filled with a mixture of healing stones, such as jade stones or turmalin stones, optionally mixed with cherry stones, which can easily be, for example, heated in the microwave or oven or cooled in the freezer, and thus can provide a calming warmth or coolness when falling-asleep. The roller is in particular then provided to be hollow inside so that it can be equipped with the above corresponding elements.

In an embodiment of the present invention, the slip of the cushion assembly or of the single pillow of the cushion assembly can, for example, be manufactured of a thin, elastic material. The slip for the side parts and/or the slip for the lower part of the neck pillow can, for example, be formed from a more stable material to provide stability to the respective pillow shape. Two or more types of materials may thus be used. A zipper may be provided to allow for a removal of the neck pillow.

The present invention is explained in more detail below under reference to the drawings.

Figure 3:
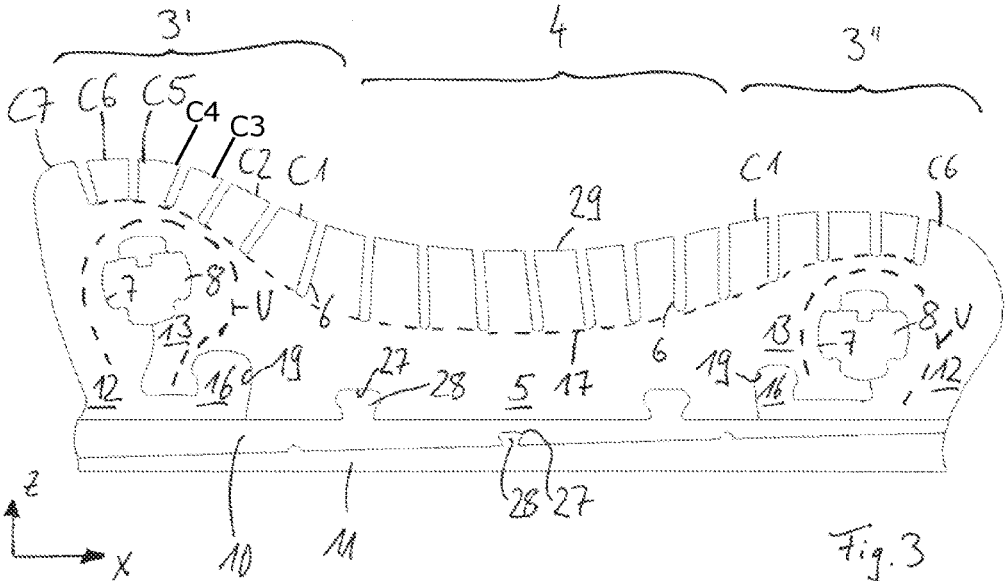
FIG. 3 shows the neck pillow of FIG. 1 in a side view.
Figure 4:
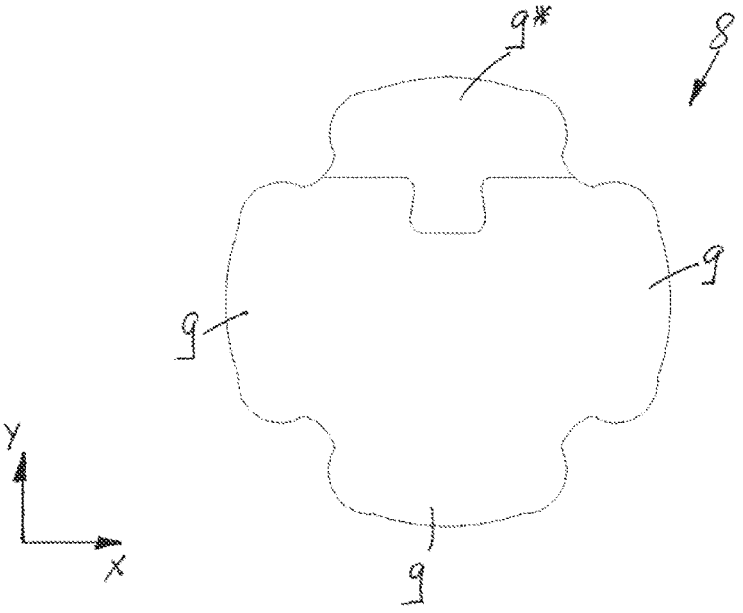
FIG. 4 shows an adjustment roller for the pillow according to FIGS. 1 and 3 in a side view.

FIGS. 1 and 3 show an inventive neck pillow 1. Neck pillow 1 comprises an overhead supporting surface 2 for the neck and head of a person. Viewed in longitudinal direction x, at first a convex shaped cervical support area 3' is provided, followed by a concave-shaped head support area 4. This is followed by a second cervical support area 3". Consequently, cervical support areas 3', 3" are provided, each having different characteristics in stiffness and shape. To change the sleeping position or supporting characteristics the neck, the neck pillow 1 can easily be turned at night. The neck pillow 1 generally comprises a supporting body 5 on which the support areas 3', 3", 4 are formed. Slots 6 are oriented in the transverse direction y and protrude from the supporting surface 2 downwards into the supporting body 5, appropriately slightly angled as the case might be. In the first cervical support area 3', and in particular there in the area of the middle cervicals C3 and C4, these slots 6 are formed with a longitudinal direction component. The lower ends of the slots 6 together form a bottom curve 17. The supporting surface 2 forms a head curve 29, when viewed in side view. The profile of the head curve 29 relative to the bottom curve 17 significantly defines the support characteristics in the individual support areas 3', 3", 4. The bottom curve 17 falls within the area of the first support surface 3' more steeply than the head curve 29. In the second cervical support area 3", the bottom curve 17 also falls more steeply than the head curve 29. However, in the second cervical support area, both curves 17, 29 are formed to be significantly flater than in the first cervical support area 3'. The highest points of the support surfaces 2 are arranged in the area of the lower cervicals C5, C6.

To adjust the support characteristics for the lower and middle cervicals, an adjustment roller 8 is provided, which is inserted into the supporting body 5 thereby oriented in the transverse direction y. The adjustment roller 8 is inserted within a receiving recess 7, which is formed complementary to the adjustment roller 8. The receiving recess 7 and the adjustment roller 8 have a non-circular shape so that the angular position of the adjustment roller can be set exactly. Different angular positions of the adjustment roller 8 effect different damping characteristics for the respective cervical support areas 3', 3". The adjustment roller 8 has a total of four radially protruding projections 9, one projection 9* of which is removable. It can be seen that in the absence of one projection 9*, the damping characteristic at this position, which is located above the missing projection 9*, may be formed to be slightly softer. Through appropriate modification of the angular position of the adjustment roller 8, the respective damping characteristics can be adjusted accordingly for one of the cervical support areas for the cervicals C3-C7.

The support for the cervicals C6 and C7 can be reduced if the area of the adjustment roller 8 without detachable projection 9* is located in an approximately 9 o'clock position. The support for the cervicals C5 and C6 can be reduced if the area of the adjustment 8 roller without removable projection 9* is located in an approximately 12 o'clock position. The support for the cervicals C3 and C4 can be reduced if the area of the adjustment roller 8 without removable projection 9* is in an approximately 3 o'clock position. The support for all of the cervicals can be slightly reduced if the area of the adjustment roller 8 without removable projection 9* is in an approximately 6 o'clock position. For projecting the relief of the cervicals most affected by the common spinal disc problems and the tilting/shifting to posterior, the adjustment roller is slightly inclined with respect to an exact 12 o'clock position; the area of the removable projection is in an 11:30 clock position to be exact.

The supporting body 5 is cut from below in the area of the receiving recess 7. This results in a U-shaped support structure, with a first U-leg 12 and a second U-leg 13, which limit the receiving recess 7 and thus enclose the adjustment roller 8. The dotted line, marked with "U", represents the U-shaped character of the encompassment. The receiving recess 7 can then be expanded by a respective spreading of the two U-legs 12, 13. The result is a gap through which the adjustment roller 8 can then be removed in the vertical direction z.

The two U-legs 12 and 13 engage positively into each another. In a distal end of one of the U-legs, in particular of the first u-leg 12, a retaining projection 16 is therefore formed which positively engages with a retaining recess 19 of the other, in particular of the second U-leg 12. The positive engagement in this case is present in the longitudinal direction x and in the vertical direction z, which is advantageous but not mandatory. The retaining projection 16 can, for example, have a mushroom shape. The positive fit can be released for disassembling via elastic deformation.

A first and second bottom plate 10, 11 is removably provided below the support body 5. These are fixed to each other or to the supporting body 5 by positive fixing device in the form of a holding recess 27 and a holding projection 28 which are respectively fixed to each other to the supporting body 5. The bottom plates 10, 11 are formed to incline and generally have a wedge shape. Via different mounting combinations, the supporting body 5 can either be increased, tilted forward or backward, inclined or double inclined rearwards or to the front. The tilt angle of a bottom plate angle is approximately 2°. The angle of the supporting body 5 can thus be adjusted between 0°, 2° and 4°. The height is on average 1 cm so the height of the supporting body 5 can be adjusted by up to 2 cm.

If in the field of the present description "transversely inwardly" and "transversely outwardly" is mentioned. "Transversely inwardly" means a zone I, which represents approximately one-third of the width of neck pillow (extension in the transverse direction y) and is located centrally in the transverse direction. "Transversely outwardly" each designates a zone A left or right of zone I transversely inwardly, which represents about one-third of the width of the neck pillow (see FIGS. 7 and 8).

Figure 2:
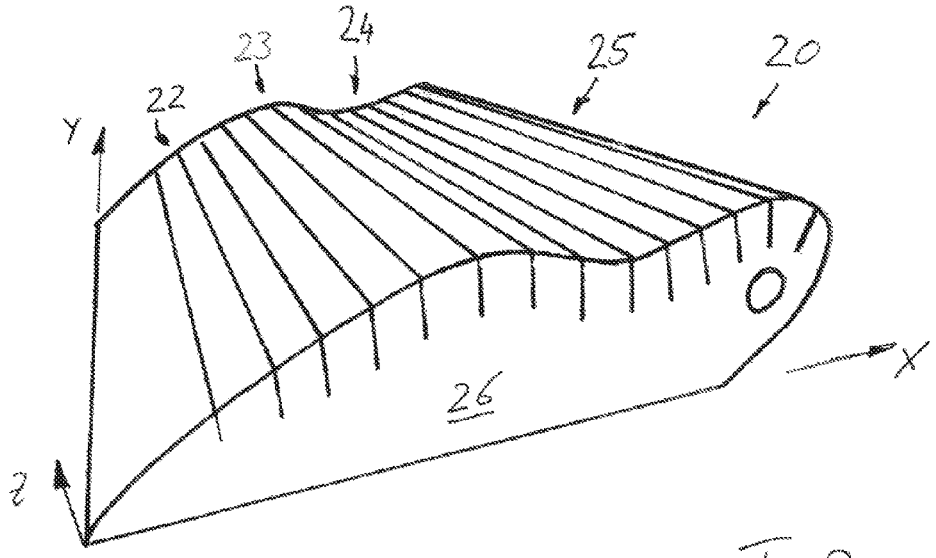
FIG. 2 shows an inventive side pillow in a perspective view.
Figure 5:
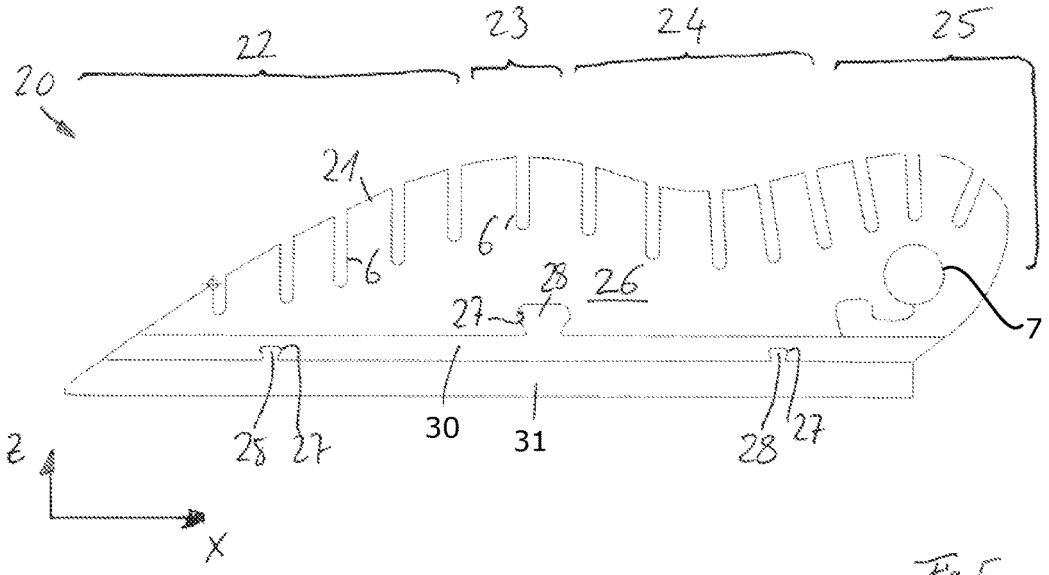
FIG. 5 shows the side pillow of FIG. 2 in a side view.

FIGS. 2 and 5 show the side pillow 20 which has a supporting surface 21 at its top. Evident is the steady increasing forearm support area 22, the adjoining convex shaped wrist support area 23, the adjoining concave finger support area 24, and the convex-shaped grab area 25. Below the grab area 25 in the respective supporting body 26, a receiving recess 7 is again arranged in which an adjustment roller 8 can be inserted in the same manner with respect to the neck pillow 1 described above. The positive fit attachment results analogously via U-legs 12 and 13, analogous to the neck pillow 1.

Figure 6:
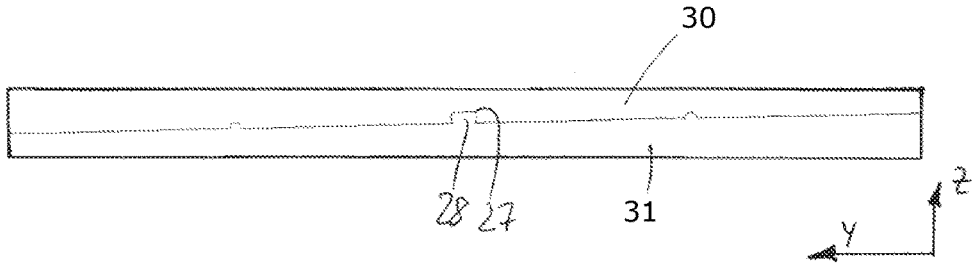
FIG. 6 shows a bottom plate for the side pillow of FIG. 5 in a front view.

FIG. 6 shows fourth and fifth bottom plates 30, 31 (which are also shown in FIG. 5). The fourth and fifth bottom plates 30, 31 are generally formed analogously to the first and second bottom plate and may in the dimensions also substantially conform to what has been described with respect to the first and second bottom plates 10, 11. The key exception is, however, that the fourth and fifth bottom plates 30, 31, are mounted under the side pillow under a rotation of 90°. The inclination in the transverse direction y can thus be adjusted, whereas for the neck pillow, the inclination in longitudinal direction x is adjusted.

Figure 7A:
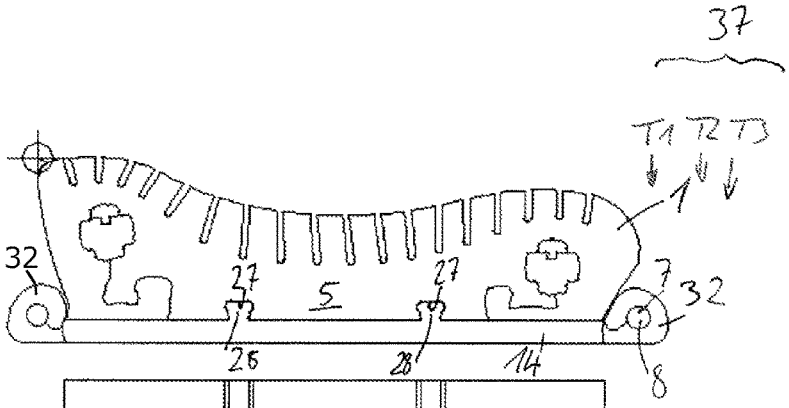
FIG. 7A shows a third base plate for the neck pillow of FIGS. 1 and 3 in a side view.
Figure 7B:
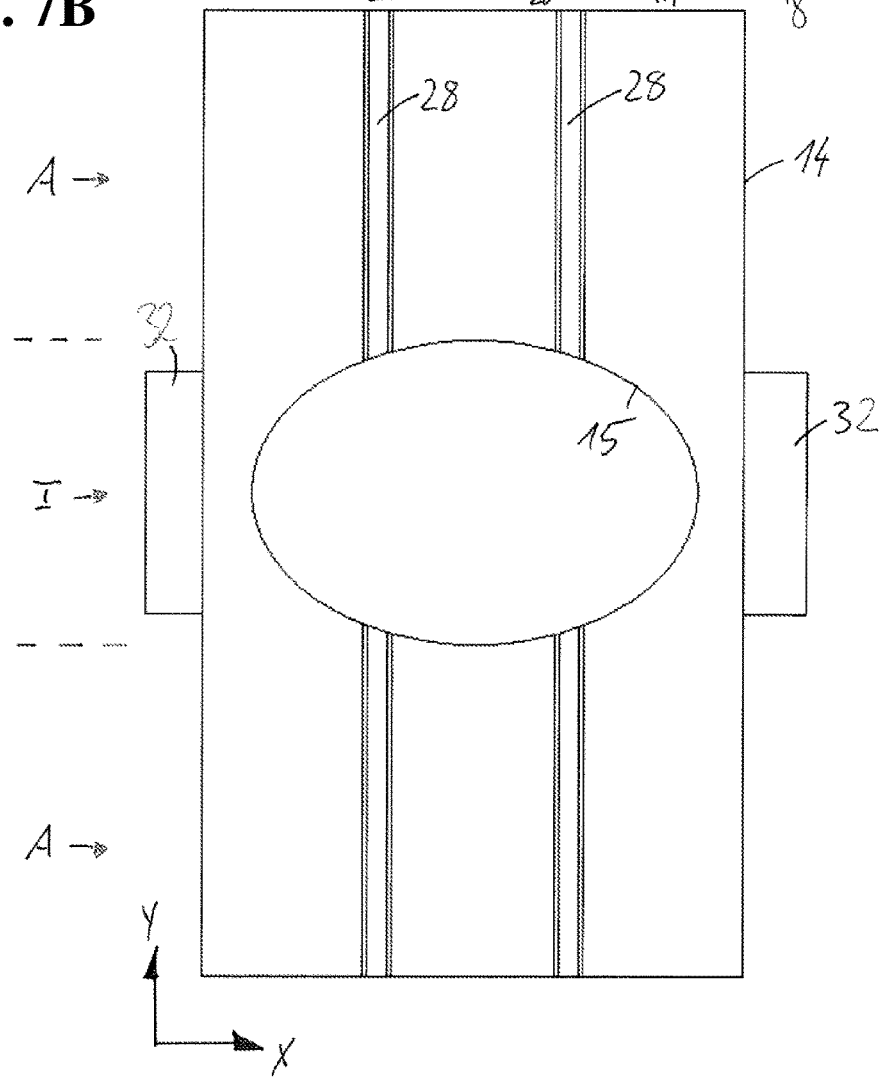
FIG. 7B shows a third base plate for the neck pillow of FIGS. 1 and 3 in a plan view.

FIGS. 7A and 7B shows a third bottom plate 14. This has a central head recess 15 which is disposed below the supporting body 5 centrally inside when viewed both in the longitudinal direction x and in the transverse direction y (zone I). This head recess 15 creates a defined weakening of the support body 5 in the area of the head support area 4. The head recess 15 is provided solely in the transversal inner section (zone I). The outer transversal areas (zones A) still support the person's head, particularly if the person turns to a side position.

A respective thoracic vertebra roller 32 overlaps the supporting body 5 in the longitudinal direction x. As is evident in particular from FIG. 7A, the thoracic vertebra roller 32 shown on the right can provide a vertical support for the thoracic vertebrae areas T1 to T3 in a transversely inward area. To this extent, the thoracic vertebrae roller 32 overlaps the cervical support area 3' in the longitudinal direction x and forms a thoracic vertebra support area 37. The thoracic vertebrae roller 32 again has an internal receiving recess 7 which is equipped with an adjusting roller 8. Regarding this adjustment roller 8, it is sufficient that it is shaped circular; an exact adjustability is here not necessary.

Figure 8:
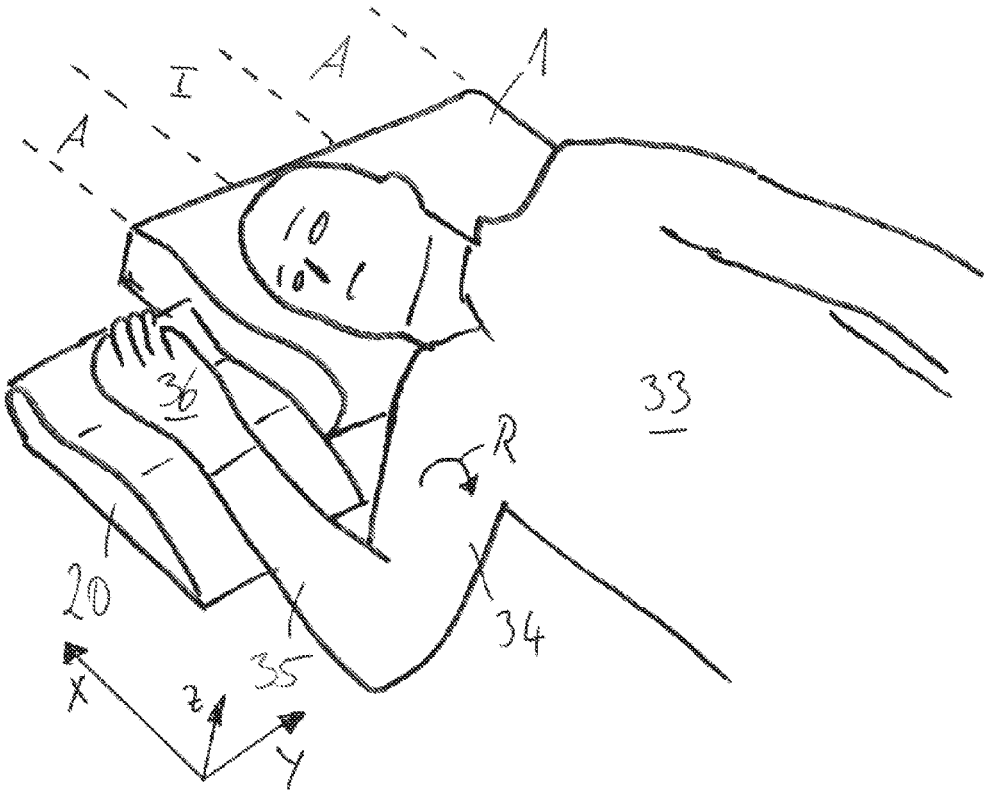
FIG. 8 shows an assembly with a neck pillow and a side pillow.

FIG. 8 shows the inventive assembly comprising a neck pillow and a side pillow 20. Only one side pillow 20 is shown, a second one can be readily provided. The person 33 is shown lying in a side position. The head and neck lie on the neck pillow 1. The forearm 35 and the hand 36 lie intentionally on the side pillow. The lower part of the upper arm 34 is aligned angled with respect to the body and the forearm 35. It can be seen that the forearm 35 is slightly raised by the side pillow 20 so that the upper arm 34 is twisted in a direction of rotation R. If the side pillow 20 were not present, the upper arm 34 would be twisted against the direction of rotation R, which would be unpleasant for the person 33 and disadvantageous for the spine and the nervous system being protected against stressful forces acting against it.

Figure 10:
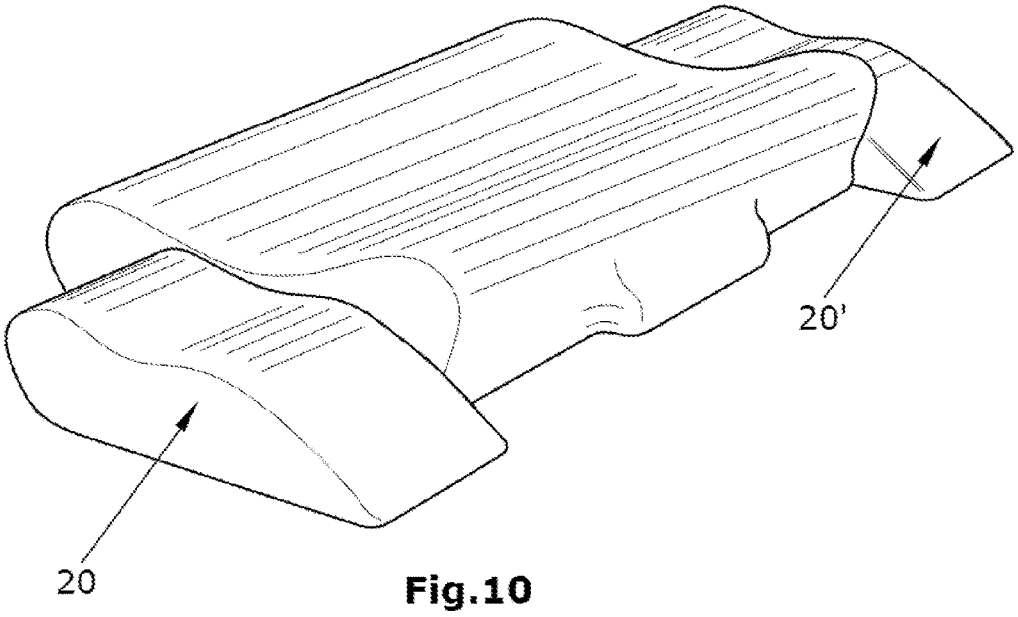
FIG. 10 shows the neck pillow of the present invention with a first side pillow and with a second side pillow.
Figure 11:
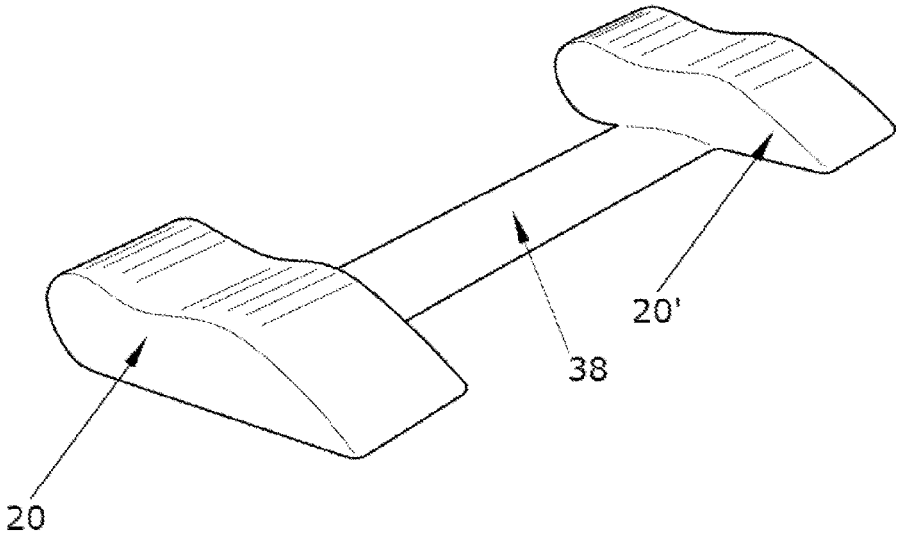
FIG. 11 shows the first side pillow and the second side pillow of the present invention connected to each other via a fastening device.

FIG. 10 shows the neck pillow 1 of the present invention with a first side pillow 20 and with a second side pillow 20'. FIG. 11 shows the first side pillow 20 and the second side pillow 20' of the present invention connected to each other via a fastening device 38.

This pillow of the present invention implements the insight that a frequent straightening of the cervical spine is caused by a tilting/subluxation of the lower cervicals posteriorly and inferiorly and loss of height of the posterior disc space, in particular in the area C6. The angle between the atlas and the axis (Dens-line) and the rest of the spine is thereby adversely changed in terms of a reduction in the angle at 90° in a side view. An extension of the vertebra base plates through a line posteriorly in X-ray lateral view shows an early intersection of the line of the overlying vertebra with the respective line of the underlying one within the image instead of being outside. This straightening and posteriorization of the overlying vertebrae triggered in the lower area of the cervical spine can be positively influenced by a defined support of the lower/underlying cervicals in supine position by pressure in line of the intervertebral disc space and relief of the upper cervicals during nocturnal sleep. Previous neck support pillows do not consider this fact because the known pressure- and curve profiles effecting the upper cervical spine have too large a radius of curvature in the support area of the spinal processes of the cervicals, thus effecting pressure on the axis reaching far to the posterior and thus on the atlas. A support of the otherwise heavily loaded 5th and particularly 6th cervical in a supine position and on the side and relief of upper cervicals is therefore only possible with a significantly smaller radius of curvature and a displacement of the highest point of pressure and support in the area of the lower cervical spine through a V-shape. Also, when lying on the side, the natural V-shaped indentation of the shoulder lying down on the bed can only be achieved by a corresponding shape of the pillow. To provide a natural and thus a straight cervical spine when lying on the side and a lordotoic one when in the suspine position, the elevated position of the head when lying on the side is thus important, and in the supine position, when the head is heavier and sinks more, a steeper drop within the pillow to relieve the upper cervicals and support of lower cervicals is important. In the pillow of the present invention, this V-shape is mainly achieved by a shoulder contact surface, which is negatively rising, and a support surface for the cervical spine, which has its highest point and/or strongest pressure point in the area of the lower cervicals and which rapidly falls or softens in a direction of the head.

Figure 9:
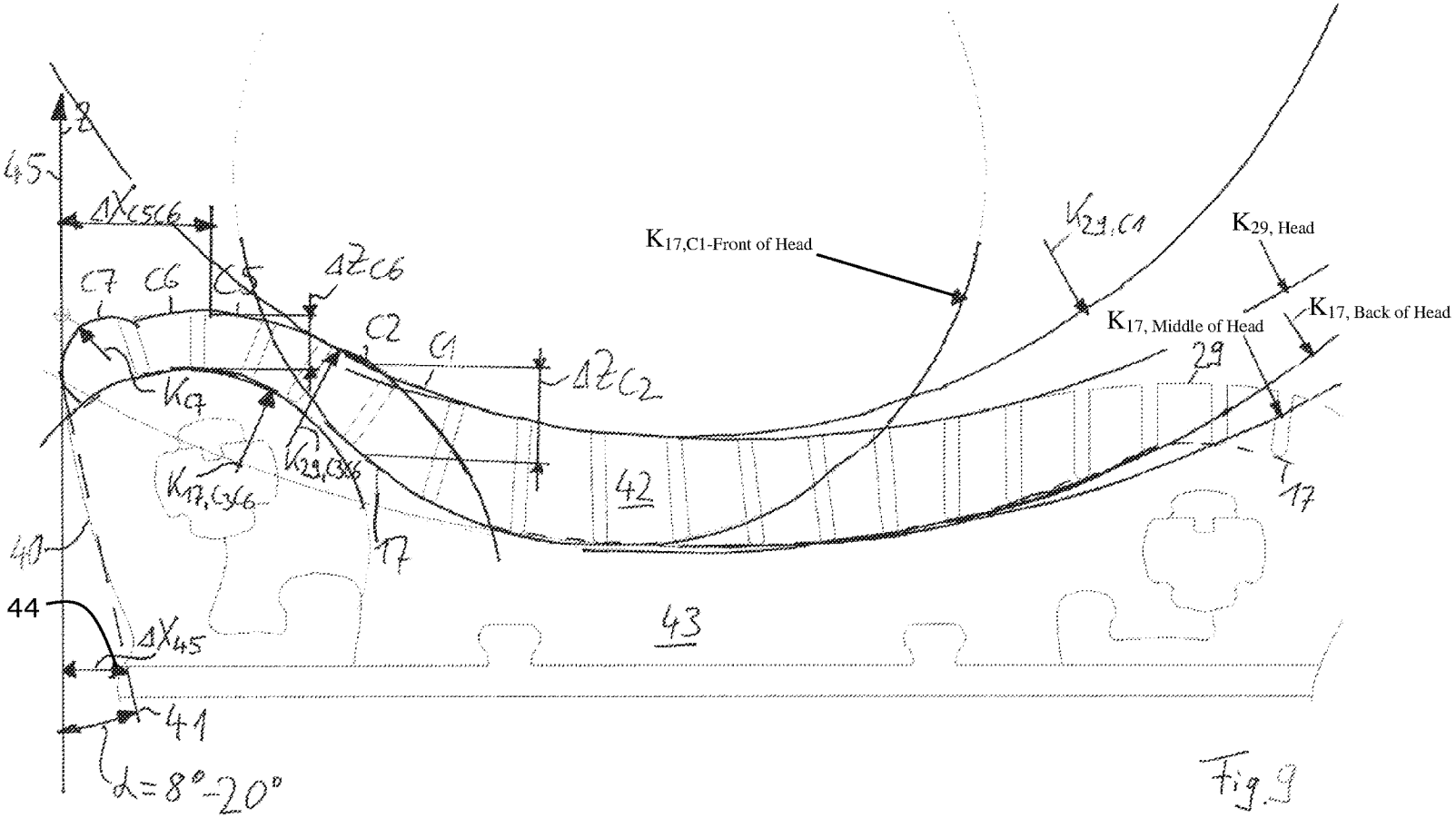
FIG. 9 shows a detailed view of the neck pillow of FIG. 1 in a side view with pasted construction lines.

With the help of FIG. 9, important parameters of the neck pillow are represented, so that this is able to provide the highest pressurization to the cervicals in the area of the lower cervicals C5-C7 and to relieve the upper cervicals C1-C3. The direction of the supporting force is intended to be as parallel as possible to the disc spaces between the cervicals C5/C6 and C6/C7. This particularly avoids that cervical C5 or C6 is exposed to an unwanted tilting impact/shift posteriorly and inferiorly.

A defined reference to a person sleeping is provided by the shoulder contact surface 40. The person will intuitively rest the shoulder against thereabout and thus correctly be aligned in the reference system of the pillow. The shoulder of the person starts from the first thoracic vertebra to which also the first rib bow is attached. Now that the shoulder of the person lies at the shoulder contact surface 40, the cervical C7 comes to rest at the cervical contact area C7.

In order that the pillow is able to pressurize the cervicals C6 and C7, the shoulder contact surface 40 has an average negative inclination 41 $\alpha$ of 8° to 20°, for example, about 11°, and can, for example, be substantially flat. The term "negative inclination" means that when viewed from the foot of the pillow 44, the shoulder contact surface 40 forms, with increasing height, a projection towards the thoracic spine, in particular with an extension in the x-direction $\Delta X_{45}$ of at least 1 cm.

The pillow itself comprises a rigid portion 43 which is covered on the upper side by a soft portion 42. The head of the person and the person's cervical lie on the soft portion. The soft portion 42 has a lower hardness than the hard portion 43. The gravitational force is guided through the soft portion 42 onto the hard portion 43. In the pillow of the present invention, the soft portion 42 and the hard portion 43 are formed of the same material. The greater softness of the soft portion 42 is achieved via the slots 6', 6". It is also possible to form the soft portion 42 by a material having a lower compressive hardness than the material forming the hard portion 43. The bottom curve of the slots 17 generally forms the border between the rigid portion 43 and the soft portion 42. The head curve 29 is defined by the contact surfaces 2, 3 on top of the soft portion 42. The highest point in the bottom curve 17 and thus of the hard portion 43 in the area of the cervical spine must be in the region of the cervicals C5 and C6. The same applies to the highest point of the head curve 29. The highest points of both the bottom curve of the slots 17 and the head curve 29 should have a maximum axial distance of 6 cm ($\Delta X_{C5C6}$), for example, a maximum of 4.5 cm, from the foremost point of the pillow 45 of the shoulder contact surface 40.

It is important that a "fast" transition from the rising shoulder contact surface 40 to the approximately almost horizontally aligned contact surfaces of the cervicals C5 and C6 be provided. To this end, the pillow has in the area of the contact surfaces of the cervical C7 a radius of curvature $K_{C7}$ having a maximum of 2 cm, for example, a maximum of 1.5 cm. This enables the pillow to "bore" wedge-like in the direction of the cervical C6. The pad can exert a high supporting effect on the lower cervicals C5-C7.

For concentrating the supporting force on the lower cervical spine C5-C7, the soft portion 42 is formed to be thinner in the area of the vertebrae C5 and C6 than in the area of the cervicals C1 and C2. This is achieved via a decreasing curvature of the bottom curve 17 between the areas C3 and C6, which have a maximum average radius of curvature $K_{17,C3C6}$ of 6 cm. Whereas the soft portion 42 has in the area C6 a thickness $\Delta Z_{C6}$ having a maximum of approximately 2 cm (for example, at least 0.5 cm), the bottom curve 17 falls so rapidly in the region between C6 and C2 that the soft portion 42 has, in the area C2, a thickness $\Delta Z_{C2}$ of at least 2.0 cm, for example, at least 2.5 cm (in particular a maximum of 3 cm). An average radius of curvature $K_{29,\ C3C6}$ of the head curve 29 between the areas C3 and C6 can, for example, have a maximum of 10 cm and is larger than the average radius of curvature $K_{17,C3C6}$ of the bottom curve in this area. The slots in the area of the cervicals C1 to C3 are aligned at an angle of at least 25° with respect to the vertical. This allows a tilting of the adjacent vertebral support areas downwards, which may again reduce the supporting force for the atlas.

In its further course, the pillow can, for example, have one or more of the following curvature values which include a range of +/−3 cm:

The curvature $K_{29,C1}$ of the head curve 29 in the region of the first cervical C1 is a maximum of 25 cm, for example, about 20 cm.

The curvature $K_{29,Head}$ of the head curve 29 in the region of the head is a maximum 35 cm, for example, approximately 30.5 cm.

The curvature $K_{17,C1\text{-}Front\ of\ Head}$ of the head curve 17 in the area between the first cervical and the front head support is a maximum of 15 cm, for example, approximately 10.5 cm.

The curvature $K_{17,\ Middle\ of\ Head}$ of the bottom curve 17 in the region behind the central head support area is a maximum of 42 cm, for example, about 37 cm.

The curvature $K_{17,C1\text{-}Back\ of\ Head}$ to the bottom curve 17 in the area of the rear head support is a maximum of 35 cm, for example, about 30 cm.

The neck pillow of the present invention thus conforms in its course of the bottom curve approximately to an exaggerated curve of the cervical spine of most people. When pressing the soft portion and parts of the hard portion, the course of the bottom curve then generally corresponds to the optimum course of the cervicals of the consumer.

All the length dimensions given within the present application are valid for a pillow for adults. For a children's pillow, all absolute length dimensions given within the present application (including curvature values) are to be reduced by 25%. Relative dimensions as well as angle dimensions remain unchanged.

The present invention is not limited to embodiments described herein; reference should be had to the appended claims.

REFERENCE SIGNS

1 neck pillow
2 supporting surface
3 cervical support area
4 head support area
5 supporting body
6', 6" slot
7 receiving recess
8 adjustment roller
9 radial projection
10 first bottom plate
11 second bottom plate
12 first U-leg
13 second U-leg
14 third bottom plate
15 head area recess
16 retaining projection
17 bottom curve of the slots
19 retaining recess
20 side pillow
21 supporting surface
22 forearm support area
23 wrist support area
24 finger support area
25 grab area
26 supporting body
27 holding recess
28 holding projection
29 head curve
30 fourth bottom plate
31 fifth bottom plate
32 thoracic vertebra roller
33 person
34 upper arm
35 forearm
36 hand
37 thoracic vertebrae support area
38 fastening device
40 shoulder contact surfaces
41 average inclination of the shoulder contact surface
42 soft portion
43 rigid portion
44 foot of the pillow
45 foremost point of the pillow
C1 . . . C7 support area for cervical number 1 . . . 7
U U-shaped encompassment
R direction of rotation of shoulder joint
a average inclination angle of the shoulder contact surface
$\Delta X_{45}$ distance of the foot of the pillow to foremost point of the
shoulder contact surfaces
$\Delta X_{C5C6}$ distance of the highest point to foremost point of the shoulder
contact surfaces
$K_{C7}$ radius of curvature of C7-support surface
$K_{17,C3C6}$ radius of curvature of the bottom curve in the area of the support surface C3-C6
$K_{29,C3C6}$ radius of curvature of the head curve in the area of the support surface C3-C6
$K_{29,c1}$ radius of curvature of the head curve in the area of the first cervical C1
$K_{29,Head}$ radius of curvature of the head curve in the area of the head
$K_{17,C1\text{-}Front\ of\ Head}$ radius of curvature of the bottom curve in the area between the first cervical C1 and the fore head
$K_{17,C1\text{-}Middle\ of\ Head}$ radius of curvature of the bottom curve in the area of the middle head
$K_{17,C1\text{-}Back\ of\ Head}$ radius of curvature of the bottom curve in the area of the rear head
$\Delta Z_{C6}$ thickness of the soft portion in the area C6
$\Delta Z_{C6}$ thickness of the soft portion in the area C2

What is claimed is:

1. A neck pillow comprising:

a supporting body (5) comprising, when viewed with the neck pillow lying flat:
a bottom side;
a top side;
a left side;
a right side;
a foot (44) arranged at the bottom side;
a shoulder contact surface (40) comprising a foremost point and a negative inclination which starts from the foot (44), the shoulder contact surface being arranged at the bottom side;
a supporting surface (2) which, when viewed from the left side or from the right side, comprises at least one cervical support area (3', 3") configured to be convex-shaped and a head support area (4) configured to be concave-shaped;

a rigid portion (43) comprising a rigid portion hardness and a bottom curve (17) which comprises a highest point; and a soft portion (42) which, when viewed from the left side or from the right side, is arranged on an upper side of the rigid portion (43), the soft portion comprising a soft portion hardness which is less than the rigid portion hardness, wherein, the supporting body (5) is configured so that each of a head and a cervical spine of a person rests on the soft portion (42), while in use, the neck pillow is arranged so that a highest pressure on the cervical spine of the person exists in an area of a fifth cervical (C5) and a sixth cervical (C6) of the person, a supporting point for a third cervical (C3) and a fourth cervical (C4) of the person is lower than a supporting point for the fifth cervical (C5) of the person, while in use, the highest point of the neck pillow is arranged in the area of the fifth cervical and the sixth cervical of the person (C5, C6), and the shoulder contact surface (40) further comprises, when viewed from the left side or the right side, an average radius of curvature ($K_{C7}$) of less than 2 cm, a center of the average radius of curvature ($K_{C7}$) being located in a support area of the sixth cervical of the person.

2. The neck pillow as recited in claim 1, further comprising a head curve (29) comprising a highest point, the highest points of the bottom curve (17) and/or of the head curve (29) having an axial distance ($\Delta X_{C5C6}$) have a maximum of 6 cm from the foremost point (45) of the shoulder contact surface (40); or wherein, a transition of the shoulder contact surface (40) to a support surface of the fifth and sixth cervical (C5, C6) of the person has a maximum radius of curvature ($K_{C7}$) of 2 cm; or further comprising the head curve (29), wherein the bottom curve (17) comprises, between support areas of the second and sixth cervical (C2, C6) of the person, a declining curvature having an average radius of curvature ($K_{17,C3C6}$) having a maximum of 6 cm, and the head curve (29) has, between the support areas of the second and sixth cervical (C2, C6) of the person, a decreasing curvature with an average radius of curvature ($K_{29,\ C3C6}$) which is larger than the radius of curvature ($K_{17,\ C3C6}$) of the bottom curve (17) in said area; or wherein, the soft portion (42) has, in the support area of the sixth cervical C6 of the person, a smaller thickness than in the support area of the second cervical (C2) of the person.

3. The neck pillow as recited in claim 2, wherein, the supporting body (5) further comprises a plurality of slots (6) projecting from the at least one cervical support area (3', 3") and from the head support area (4) into the supporting body (5), the slots (6) in the head support area (4) being configured to project deeper into the supporting body (5) than the slots (6) in the at least one cervical support area (3', 3").

4. The neck pillow as recited in claim 2, wherein, the supporting surface (2) comprises two cervical support areas (3-', 3-") which are arranged on respective opposite sides of the head support area (4) on the top side and the bottom side of the neck pillow, and the supporting body (5) further comprises a plurality of slots (6) projecting from each of the two cervical support areas (3', 3") and from the head support area (4) into the supporting body (5), wherein a profile of the head curve (29) of the slots (6) and/or a course of a bottom curve (17) of the slots (6) and/or an alignment of the slots (6) at the two cervical support areas (3', 3"), is formed differently.

5. The neck pillow as recited in claim 2, further comprising:

an adjustment roller (8);

wherein, the supporting body (5), in a longitudinal region (x) of the at least one cervical support area (3', 3"), when viewed from the left side or from the right side, further comprises a recess (7) which is configured to receive the adjustment roller (8), the adjustment roller (8) being fixable in a form-fitting manner in different angular positions within the recess (7).

6. The neck pillow as recited in claim 5, wherein, the adjustment roller (8), when viewed from the left side or from the right side, comprises a plurality of radial projections (9) which are circumferentially distributed, at least one of the plurality of radial projections (9*) being configured to be removable.

7. The neck pillow as recited in claim 6, wherein the supporting body (5) is cut in a region of the recess (7) so as to form two U-legs (12, 13) which surround the recess (7) in a U-shaped manner, the two U-legs (12, 13), when seen in the longitudinal direction (x) or in a longitudinal direction (x) and height direction (z), are arranged to interlock in a form-fitting manner.

8. The neck pillow as recited in claim 1, further comprising a head curve (29) comprising a highest point, the highest points of the bottom curve (17) and/or of the head curve (29) having an axial distance ($\Delta X_{C5C6}$) having a maximum of 6 cm from the foremost point (45) of the shoulder contact surface (40), wherein, a transition of the shoulder contact surface (40) to a support surface of the fifth and sixth cervical (C5, C6) of the person has a maximum radius of curvature ($K_{C7}$) of 2 cm, the bottom curve (17) comprises, between support areas of the second and sixth cervical (C2, C6) of the person, a declining curvature having an average radius of curvature ($K_{17,C3C6}$) having a maximum of 6 cm, and the head curve (29) has, between the support areas of the second and sixth cervical (C2, C6) of the person, a decreasing curvature with an average radius of curvature ($K_{29,\ C3C6}$) which is larger than the radius of curvature ($K_{17,\ C3C6}$) of the bottom curve (17) in said area, and the soft portion (42) has, in the support area of the sixth cervical C6 of the person, a smaller thickness than in the support area of the second cervical (C2) of the person.

9. The neck pillow as recited in claim 1, further comprising:

at least one inclined bottom plate (10, 11) fixed below the supporting body (5).

10. The neck pillow as recited in claim 1, further comprising:

a bottom plate (14) comprising a head area recess (15) arranged below the supporting body (5).

11. The neck pillow as recited in claim 10, wherein, when seen in the longitudinal direction (x), a thoracic vertebra support area (32) is followed to the cervical vertebrae area (3), which is provided only in a central region (I) of the neck cushion (1) when seen in the transverse direction (y), and the thoracic vertebrae support area (32) is formed integrally with the bottom plate (14) having the head area recess (15).

12. A cushion assembly comprising:

a neck pillow as recited in claim 1, a first side pillow (20) comprising a support body (26) having a supporting surface (21), a rising forearm support area (22), a convex-shaped wrist support area (23), a concave-shaped finger support area (24), and a convex shaped grab area (25), the first side pillow (20') being arranged on the left side or on the right side of the neck pillow.

13. The cushion assembly as recited in claim 12, further comprising:

a second side pillow (20"), the first side pillow (20') being arranged on the left side of the neck pillow and the second side pillow (20") being arranged on the right side of the neck pillow.

14. The cushion assembly as recited in claim 13, wherein, the first side pillow and/or the second side pillow is connected via a fastening device to the neck pillow and/or to an additional side pillow.

15. A cushion assembly comprising:

a neck pillow comprising, when viewed with the neck pillow lying flat:

a bottom side;

a top side;

a left side;

a right side;

a supporting body (5) comprising:

a foot (44) arranged at the bottom side, a shoulder contact surface (40) comprising a foremost point and a negative inclination which starts from the foot (44), the shoulder contact surface being arranged at the bottom side, a supporting surface (2) which, when viewed from the left side or from the right side, comprises at least one cervical support area (3',3") configured to be convex-shaped and a head support area (4) configured to be concave-shaped, a rigid portion (43) comprising a rigid portion hardness and a bottom curve (17) which comprises a highest point, and a soft portion (42) arranged on an upper side of the rigid portion (43), the soft portion comprising a soft portion hardness which is less than the rigid portion hardness, wherein, the supporting body (5) is configured so that each of a head and a cervical spine of a person rests on the soft portion (42), while in use, the highest point of the neck pillow is arranged in an area of the fifth and sixth cervical of the person (C5, C6), and the shoulder contact surface (40) further comprises, when viewed from the left side or the right side, an average radius of curvature ($K_{C7}$) of less than 2 cm, a center of the average radius of curvature (KC7) being located in a support area of the sixth cervical of the person; and a first side pillow (20) comprising:

a support body (26) having a supporting surface (21), a rising forearm support area (22), a convex-shaped wrist support area (23), a concave-shaped finger support area (24), and a convex shaped grab area (25).

16. The cushion assembly as recited in claim 15, further comprising a head curve (29) comprising a highest point, the highest points of the bottom curve (17) and/or of the head curve (29) having an axial distance ($\Delta X_{C5C6}$) have a maximum of 6 cm from the foremost point (45) of the shoulder contact surface (40); or wherein, a transition of the shoulder contact surface (40) to a support surface of the fifth and sixth cervical (C5, C6) of the person has a maximum radius of curvature ($K_{C7}$) of 2 cm; or further comprising the head curve (29), wherein the bottom curve (17) comprises, between support areas of the second and sixth cervical (C2, C6) of the person, a declining curvature having an average radius of curvature ($K_{17,C3C6}$) having a maximum of 6 cm, and the head curve (29) has, between the support areas of the second and sixth cervical (C2, C6) of the person, a decreasing curvature with an average radius of curvature ($K_{29,\ C3C6}$) which is larger than the radius of curvature ($K_{17,\ C3C6}$) of the bottom curve (17) in said area; or wherein, the soft portion (42) has, in the support area of the sixth cervical C6 of the person, a smaller thickness than in the support area of the second cervical (C2) of the person.

17. The neck pillow as recited in claim 16, wherein, the supporting body (5) further comprises a plurality of slots (6) projecting from the at least one cervical support area (3',3") and from the head support area (4) into the supporting body (5), the slots (6) in the head support area (4) being configured to project deeper into the supporting body (5) than the slots (6) in the at least one cervical support area (3', 3").

18. The cushion assembly as recited in claim 16, wherein, the supporting body (5) further comprises a supporting face (2) comprising two cervical support areas (3-', 3-") which are arranged on respective opposite sides of the head support area (4), wherein the profile of the head curve (29) of the slots (6) and/or a course of the bottom curve (17) of the slots (6) and/or an alignment of the slots (6) at the two cervical support areas (3-', 3-") is formed differently.

19. The cushion assembly as recited in claim 16, further comprising:

an adjustment roller (8);

wherein, the supporting body (5), in a longitudinal region (x) of the at least one cervical support area (3', 3"), when viewed from the left side or from the right side, further comprises a recess (7) which is configured to receive the adjustment roller (88', 8"), the adjustment roller (8) being fixable in a form-fitting manner in different angular positions within the recess (7).

20. The cushion assembly as recited in claim 19, wherein, the adjustment roller (8), when viewed from the left side or from the right side, comprises a plurality of radial projections (9) which are circumferentially distributed, at least one of the plurality of radial projections (9*) being configured to be removable.

21. The cushion assembly as recited in claim 20, wherein the supporting body (5) is cut in a region of the recess (7) so as to form two U-legs (12, 13) which surround the recess (7) in a U-shaped manner, the two U-legs (12, 13), when seen in the longitudinal direction (x) or in a longitudinal direction (x) and height direction (z), are arranged to interlock in a form-fitting manner.

22. The cushion assembly as recited in claim 15, further comprising:

at least one inclined bottom plate (10, 11) fixed below the supporting body (5).

23. The cushion assembly as recited in claim 15, further comprising a head curve (29) comprising a highest point, the highest points of the bottom curve (17) and/or of the head curve (29) having an axial distance ($\Delta X_{C5C6}$) having a maximum of 6 cm from the foremost point (45) of the shoulder contact surface (40), wherein, a transition of the shoulder contact surface (40) to a support surface of the fifth and sixth cervical (C5, C6) of the person has a maximum radius of curvature ($K_{C7}$) of 2 cm, the bottom curve (17) comprises, between support areas of the second and sixth cervical (C2, C6) of the person, a declining curvature having an average radius of curvature ($K_{17,C3C6}$) having a maximum of 6 cm, and the head curve (29) has, between the support areas of the second and sixth cervical (C2, C6) of the person, a decreasing curvature with an average radius of curvature ($K_{29,\ C3C6}$) which is larger than the radius of curvature ($K_{17,\ C3C6}$) of the bottom curve (17), and the soft portion (42) has, in the support area of the sixth cervical (C6) of the person, a smaller thickness than in the support area of the second cervical (C2) of the person.

24. The cushion assembly as recited in claim 15, further comprising:

a bottom plate (14) comprising a head area recess (15) arranged below the supporting body (5).

25. The cushion assembly as recited in claim 24, wherein, when seen in the longitudinal direction (x), a thoracic vertebra support area (32) is followed to the cervical vertebrae area (3), which is provided only in a central region (I) of the neck cushion (1) when seen in the transverse direction (y), and the thoracic vertebrae support area (32) is formed integrally with the bottom plate (14) having the head area recess (15).

26. The cushion assembly as recited in claim 15, further comprising:

a second side pillow, the first side pillow and the second side pillow being arranged, as seen in a transverse direction (y), on opposite respective sides of the neck pillow.

27. The cushion assembly as recited in claim 26, wherein, the first side pillow and/or the second side pillow is connected via a fastening device to the neck pillow and/or to an additional side pillow.

* * * * *